US005117820A

United States Patent [19]

Robitaille

[11] Patent Number: 5,117,820

[45] Date of Patent: Jun. 2, 1992

[54] INTRA-NASAL FILTER

[76] Inventor: Jean-Pierre Robitaille, R.R. #1 New Denmark, New Brunswick, Canada, E0J 1T0

[21] Appl. No.: 608,830

[22] Filed: Nov. 5, 1990

[30] Foreign Application Priority Data

Nov. 16, 1989 [CA] Canada ..... 2003895-1

[51] Int. Cl.[5] ..... A62B 23/06

[52] U.S. Cl. ..... 128/206.11; 128/201.18; 128/203.22

[58] Field of Search ..... 128/206.11, 204.13, 128/203.15, 201.18, 203.22

[56] References Cited

U.S. PATENT DOCUMENTS

| | | | |
|---|---|---|---|
| 480,505 | 8/1892 | Midgley | 128/206.11 |
| 1,133,770 | 3/1915 | Wedler | 128/206.11 |
| 2,241,472 | 2/1940 | Nemon | 128/206.11 |
| 2,526,586 | 10/1950 | Shuff | 128/206.11 |
| 3,145,711 | 8/1964 | Beber | 128/206.11 |
| 3,463,149 | 8/1969 | Albu | 128/206.11 |
| 4,220,150 | 9/1980 | King | 128/206.11 |
| 4,267,831 | 5/1981 | Aquilar | 128/206.11 |
| 4,573,461 | 3/1986 | Lake | 128/206.11 |

FOREIGN PATENT DOCUMENTS

| | | | |
|---|---|---|---|
| 2504003 | 10/1982 | France | 128/206.11 |
| 1-209078 | 8/1989 | Japan | 128/206.11 |

*Primary Examiner*—Edgar S. Burr
*Assistant Examiner*—Eric Raciti
*Attorney, Agent, or Firm*—Swabey Ogilvy Renault

[57] ABSTRACT

A nasal filter positionable within a nostril having a nasal vestibule merging with a nasal passage of reduced cross-sectional dimension relative to the nasal vestibule. The filter comprises an elongated cylindrical body of resilient synthetic spongy material which yields upon radial compression to assume a compressed cylindrical form of reduced, substantially uniform diameter permitting insertion into the nasal passage. The body has a length sufficient to extend through the nasal vestibule and into at least a portion of the nasal passage. The body further has a cross-sectional dimension when uncompressed such that when the filter has been inserted in the nostril and the spongy material has expanded radially, the body snugly fits within the nasal vestibule and causes an enlargement of the nasal passage.

8 Claims, 5 Drawing Sheets

INTRA-NASAL FILTER

BACKGROUND OF THE INVENTION

This invention relates to a nasal filter, more particularly to flexible filters adapted to be inserted in the nostrils of the nose for filtering nasal air.

Nasal filters are known in the art, for example, in U.S. Pat.

| | | |
|---|---|---|
| 2,426,161 | 2,433,565 | 2,526,586 |
| 2,535,155 | 2,674,245 | 2,890,695 |
| 3,463,149 | 3,747,597 | 3,802,426 |
| 3,884,223 | 3,905,335 | 4,030,491 |
| 4,052,983 | 4,280,493 | |
| and the international application WO 85/01216. | | |

The filtering devices described in the above patents, however, are deficient for one or more of the following reasons: they do not provide a secure fit within the nostrils; they contain rigid connections which can be painful; they are not readily replaceable and they generally obstruct nasal air flow, thus providing difficulty in breathing.

SUMMARY OF THE INVENTION

It is accordingly an object of this invention to overcome the above drawbacks and to provide an improved nasal filter which is comfortable to wear, permits easier breathing and yet can effectively filter dust, pollen, smoke particles, bacteria and viruses.

In accordance with the invention, there is thus provided a nasal filter positionable within a nostril having a nasal vestibule merging with a nasal passage of reduced cross-sectional dimension relative to the nasal vestibule. The filter comprises an elongated cylindrical body of resilient synthetic spongy material which yields upon radial compression to assume a compressed cylindrical form of reduced, substantially uniform diameter permitting insertion into the nasal passage. The body has a length sufficient to extend through the nasal vestibule and into at least a portion of the nasal passage. The body further has a cross-sectional dimension when uncompressed such that when the filter has been inserted in the nostril and the spongy material has expanded radially, the body snugly fits within the nasal vestibule and causes an enlargement of the nasal passage.

According to a preferred embodiment of the invention, the body of synthetic spongy material includes a radially expandable core of bacteria and viruses filtering material.

In another preferred embodiment, a plurality of longitudinally spaced-apart unidirectional valve elements is arranged in the body of synthetic spongy material to provide either an expiratory or inspiratory air flow resistance.

According to a further preferred embodiment of the invention, an active substance having a stimulating effect on olfactory receptors or a pharmaceutically active substance is embedded in the body of synthetic spongy material at a location such as to be disposed in the nasal vestibule when the filter is inserted in the nostril, for dispensing the active substance in the nasal air. Preferably, the active substance is disposed in the nasal vestibule at a location which is offset relative to central longitudinal axis of the body.

By causing an enlargement of the nasal passage, the nasal filter of the invention permits easier breathing. It also converts air turbulence which may choke some persons into a laminar air flow, and can filter dust, pollen and smoke particles as well as bacteria and viruses.

BRIEF DESCRIPTION OF THE DRAWINGS

Further features and advantages of the invention will become more readily apparent from the following description of preferred embodiments as illustrated by way of examples in the accompanying drawings, in which.

DESCRIPTION OF PREFERRED EMBODIMENTS

Figure 1:
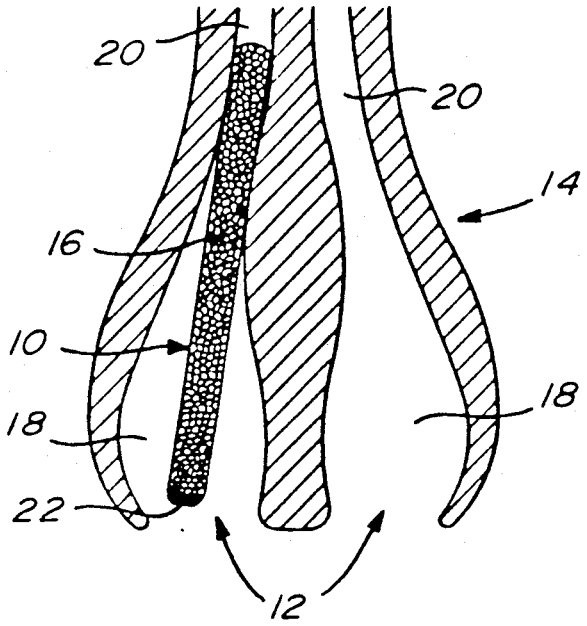
FIG. 1 is an elevational section view of a nasal filter according to a first embodiment of the invention, shown just after insertion in a nostril.
Figure 2:
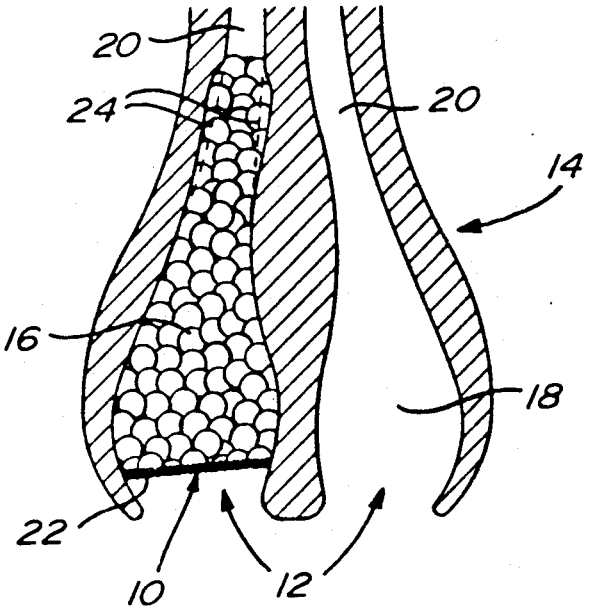
FIG. 2 is a view similar to FIG. 1, after full expansion of the synthetic spongy material and illustrating the enlargement of the nasal passage.

Referring first to FIGS. 1 and 2, there is illustrated an intra-nasal filter 10 positionable in each nostril 12 of one's nose 14, and comprising an elongated cylindrical body 16 of resilient synthetic spongy material which offers no resistance to air flow, is smooth for the mucous membrane, anti-allergenic and electrostatically charged. The synthetic spongy material is also presterilized. As shown, each nostril 12 has a nasal vestibule 18 merging with a nasal passage 20 of reduced cross-sectional dimension relative to the nasal vestibule 18. The visible end 22 of the filter is colored black for a better camouflage.

By placing the filter 10 in a sealed plastic bag and creating a vacuum inside the bag, the body 16 of synthetic spongy material will yield upon radial compression to assume a compressed cylindrical form of reduced, substantially uniform diameter (shown in FIG. 1), permitting insertion of the body 16 into the nasal passage 20. The resiliency of the synthetic spongy material is such that, when the vacuum is released and the filter is withdrawn from the bag, the spongy material will only slowly expand radially. Thus, the filter wearer will have enough time to set the filter 10 before total expansion of the spongy material. As illustrated in FIG. 1, the body 16 has a length sufficient to extend through the nasal vestibule 18 and into a portion of the nasal passage 20.

As illustrated in FIG. 2, the body 16 of synthetic spongy material further has a cross-sectional dimension when uncompressed such that when the filter 10 has been positioned within the nostril 12 and the spongy material has expanded radially, the body 16 snugly fits within the nasal vestibule 18. The pressure exerted by the body 16 on the mucous membrane is sufficient to maintain the filter 10 in place even through brutal expirations. Moreover, the pressure created by the radial expansion of the spongy material in the nasal passage 20 is such as to cause an enlargement of the portion 24 of the nasal passage, thereby permitting easier breathing. The high flexibility of the spongy material allows it to follow the fast movements of the nostrils and its resistance to tearing is such that the extraction of the filter 10 will not leave any piece of the spongy material in the nose. Extraction of the filter 10 can be performed simply by pinching and pulling out the body 16 of spongy material with one's fingers. To limit gradual obstruction of the filter 10, which may be possible in extremely dusty areas, one can promote self-cleaning by using the expiratory air flow.

Figure 3:
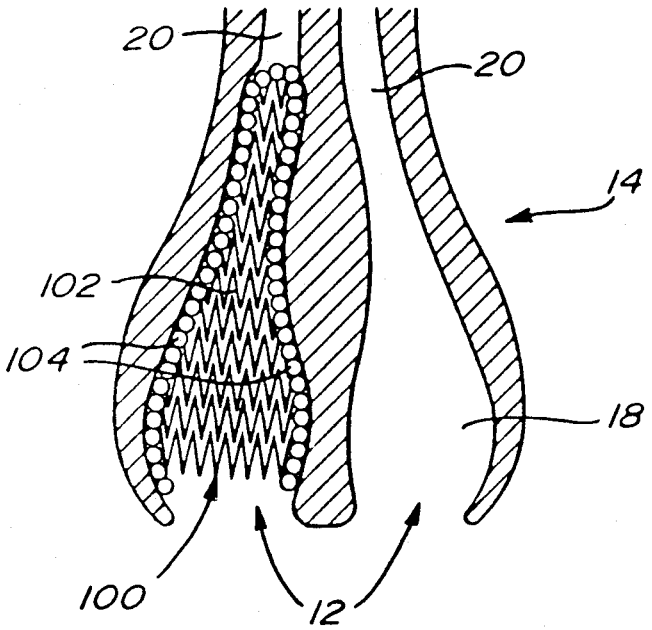
FIG. 3 is an elevational section view of a nasal filter according to a second embodiment of the invention.

For filtering bacteria and viruses, use can be made of the nasal filter 100 shown in FIG. 3, comprising a radially expandable core 102 of bacteria and viruses filtering material which is effective at 99.999% and has resistance to air flow of 0.9 cm $H_2O$ at 60 l/min. The core 102 of bacteria and viruses filtering material is partially covered with a layer 104 of resilient synthetic spongy material. As in the embodiment 10 illustrated in FIGS. 1 and 2, the filter 100 yields upon radial compression to assume a compressed cylindrical form of reduced, substantially uniform diameter permitting insertion into the nasal passage 20 and expands radially to snugly fit within the nasal vestibule 18 and cause an enlargement of the nasal passage 20.

Figure 4:
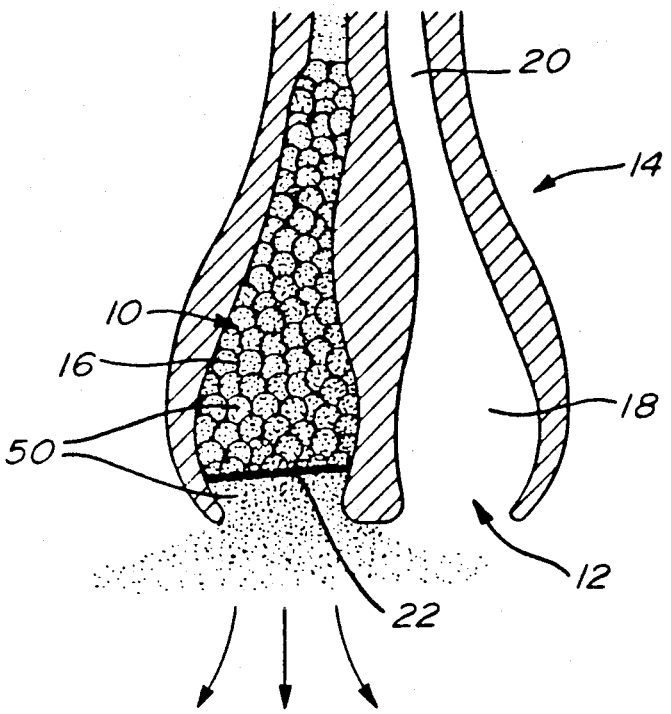
FIG. 4 is a view similar to FIG. 2 showing schematically heat and moisture exchange during expiration.
Figure 5:
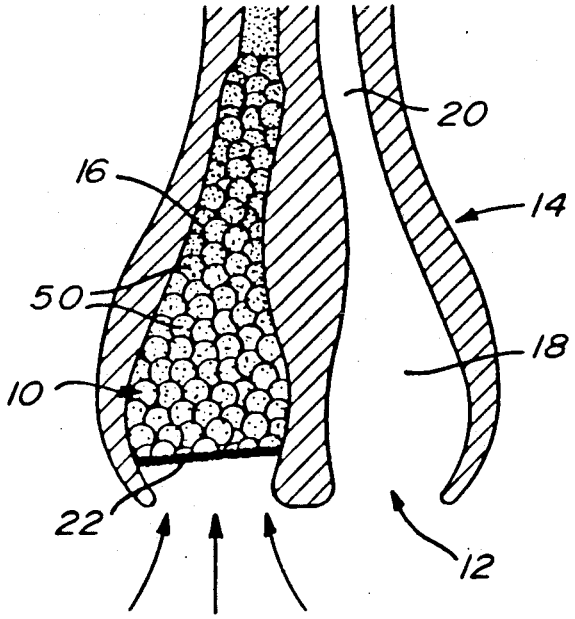
FIG. 5 is a view similar to FIG. 2 showing schematically heat and moisture exchange during inspiration.

Since the synthetic spongy material of which is made the nasal filter 10 illustrated in FIGS. 1 and 2 has heat and moisture exchange properties, the filter 10 can be used as a heat and moisture exchanger. Thus, the filter 10 has the capacity to preserve a part of expiratory heat and moisture 50 within the body 16 of synthetic spongy material, as shown in FIG. 4, and to give back part of the expiratory heat and moisture 50 at the subsequent inspiration, as shown in FIG. 5.

The expiratory purse lips technique is shown to patients having respiratory problems. It is the most effective and the easiest way to improve their gas exchanges. Indeed, the positive pressure resulting from an expiratory air flow resistance has repercussions as far as the alveolar membrane and improves the oxygen diffusion through this membrane into the blood. A nasal filter which automatically causes an accurate and stable expiratory air flow resistance will become an indispensable prothesis for the handicapped suffering from respiratory problems.

Moreover, in order to allow a patient to do some respiratory exercises, there is known a device which enables the patient to breathe in by his mouth through differently sized holes providing different air flow resistances. Thus, the patient has to breathe through his mouth as much as 60 minutes a day, which may irritate the patient. One can do the same exercises in a more physiological way with an intra-nasal filter adapted to build up a variety of inspiratory air flow resistances.

Figure 6:
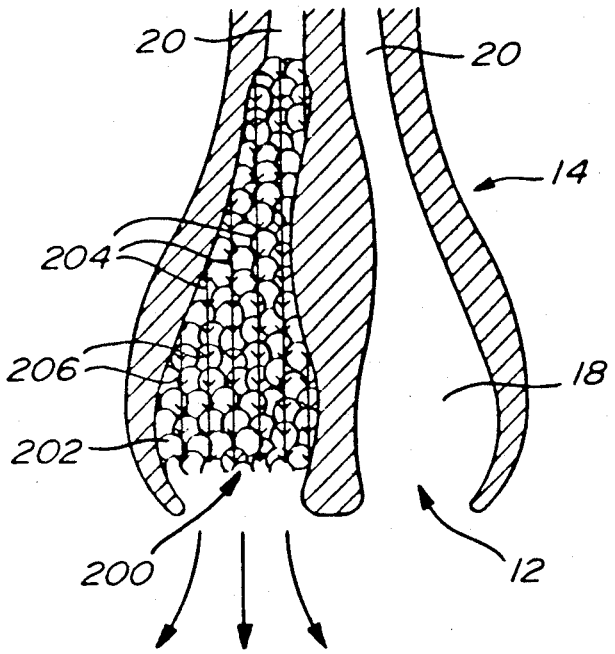
FIG. 6 is an elevational section view of a nasal filter according to a third embodiment of the invention, showing closed one-way valve elements during expiration.
Figure 7:
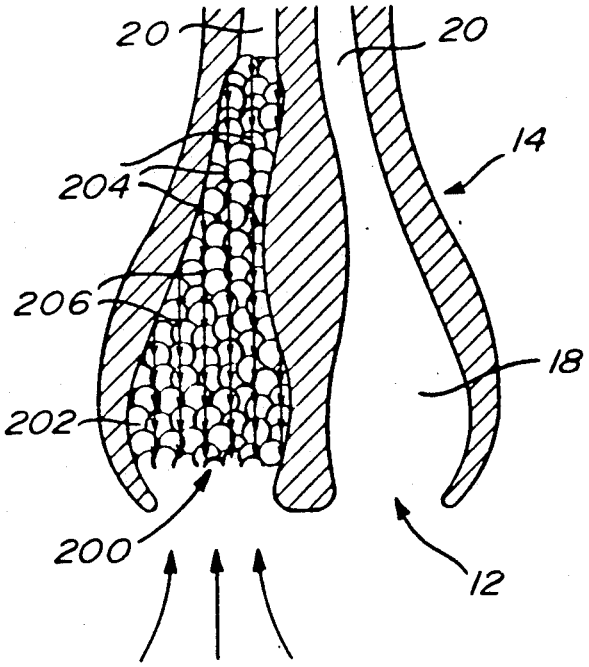
FIG. 7 is a view similar to FIG. 6, showing opened one-way valve elements during inspiration.

FIGS. 6 and 7 illustrate a nasal filter 200 adapted to provide an expiratory air flow resistance. As shown, the filter 200 comprises a body 202 of resilient synthetic spongy material through which extends longitudinally a plurality of strands 204 arranged in spaced parallel relation to one another. Each strand 204 includes a plurality of longitudinally spaced-apart, outwardly projecting short filaments 206 acting as one-way valves all oriented in the same direction. Upon expiration, the expiratory air impinges on the filaments or valves 206 and causes same to project substantially perpendicularly relative to the strands 204, thereby providing the desired expiratory air flow resistance, as shown in FIG. 6. During the subsequent inspiration, the inspiratory air causes the filaments or valves 206 to lie almost flat against the strands 204, thereby providing no inspiratory air flow resistance, as shown in FIG. 7. If an inspiratory air flow resistance is desired, one just has to turn the filter 200 upside-down before its insertion into the nostril.

Figure 8:
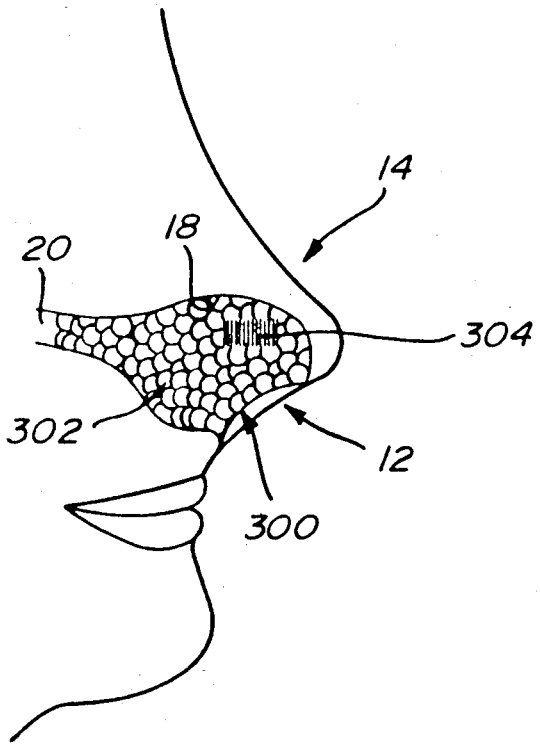
FIG. 8 is a schematic side sectional view of a nasal filter according to a fourth embodiment of the invention, shown positioned within a nostril.

FIG. 8 shows how the nasal filter can be used as a medicine dispenser which may be especially beneficial to the bronchodilatators or corticosteroid dependents or to anybody who requires a continuous level of drugs in their system (heart patients, diabetics, contraception etc.). The nasal filter 300 illustrated in FIG. 8 comprises a body 302 of resilient synthetic spongy material in which is embedded a pharmaceutically active substance 304. The substance 304 is positioned in the body 302 at a location such as to be disposed in the nasal vestibule 18 when the filter 300 is inserted in the nostril 12. Upon each inspiration, the pharmaceutically active substance 304 is dispensed in the nasal air. Furthermore, this allows a good correlation between demand and drug delivery. Indeed, if the metabolism is accelerated, then the breathing rate will increase, thereby delivering more medicine.

Moreover, by disposing the pharmaceutically active substance 304 at the top of the nasal vestibule 18 as shown in FIG. 8, the substance 304 does not substantially obstruct nasal air and a patient who anticipates a need of medicine can get more medicine by orienting his inspiratory air flow toward the substance 304.

In order to prevent certain foul odours from being detected by the olfactory receptors, it is also possible to replace the pharmaceutically active substance 304 by an active substance having a stimulating effect on the olfactory receptors corresponding to the undesired family of odours. For example, one may insert a specific perfume in the nasal filter 300.

I claim:

1. A nasal filter positionable within a nostril for filtering nasal air, said nostril having a nasal vestibule merging with a nasal passage of reduced cross-sectional dimension relative to said nasal vestibule said filter comprising an elongated cylindrical body of resilient synthetic spongy material which yields upon radial compression to assume a compressed cylindrical form of reduced, substantially uniform diameter permitting insertion into said nasal passage, said body having a length sufficient to extend through said nasal vestibule and into at least a portion of said nasal passage, and further having a cross-sectional dimension when uncompressed such that when said filter has been inserted in said nostril and said spongy material has expanded, radially, said body snugly fits within said nasal vestibule and causes an enlargement of said portion of said nasal passage.

2. A nasal filter according to claim 1, wherein said body of synthetic spongy material includes a radially expandable core of bacteria and viruses filtering material.

3. A nasal filter according to claim 1, wherein a pharmaceutically active substance is embedded in said body of synthetic spongy material at a location such as to be disposed in said nasal vestibule when said filter is inserted in said nostril, for dispensing said pharmaceutically active substance in said nasal air.

4. A nasal filter according to claim 3, wherein said body of synthetic spongy material has a central longitudinal axis and wherein said pharmaceutically active substance is disposed in said nasal vestibule at a location which is offset relative to said central longitudinal axis.

5. A nasal filter according to claim 1, wherein an active substance having a stimulating effect on olfactory receptors is embedded in said body of synthetic spongy material at a location such as to be disposed in said nasal vestibule when said filter is inserted in said nostril, for dispensing said active substance in said nasal air.

6. A nasal filter according to claim 5, wherein said body of synthetic spongy material has a central longitudinal axis and wherein said active substance is disposed in said nasal vestibule at a location which is offset relative to said central longitudinal axis.

7. A nasal filter according to claim 1, wherein said synthetic spongy material is a presterilized and anti-allergenic spongy material.

8. A nasal filter according to claim 1, wherein said synthetic spongy material is electrostatically charged.

* * * * *